United States Patent [19]

Borisch

[11] Patent Number: 5,069,257

[45] Date of Patent: Dec. 3, 1991

[54] METHOD OF REGULATING THE SPEED OF WARP THREADS AS A FUNCTION OF WEAVE PATTERN AND WARP TENSION

[76] Inventor: Fred Borisch, Breul 22, D-4400 Münster, Fed. Rep. of Germany

[21] Appl. No.: 505,756

[22] Filed: Apr. 5, 1990

Related U.S. Application Data

[63] Continuation-in-part of Ser. No. 243,302, filed as PCT/DE88/00005 Jan. 6, 1988, abandoned.

[30] Foreign Application Priority Data

Jan. 7, 1987 [DE] Fed. Rep. of Germany ..... 3700240

[51] Int. Cl.[5] ..... D03D 49/06

[52] U.S. Cl. ..... 139/99; 139/309; 139/311; 139/105

[58] Field of Search ..... 318/6, 7; 139/316, 103, 139/99, 110, 109, 105, 311, 310, 309, 413, 414, 409, 408, 35, DIG. 1; 66/210; 242/75.44

[56] References Cited

U.S. PATENT DOCUMENTS 4,582,095 4/1986 Kronholm .
4,662,407 5/1987 Duncan ..... 139/103

FOREIGN PATENT DOCUMENTS 3435391 10/1983 Fed. Rep. of Germany .
8222751 2/1984 Fed. Rep. of Germany .
3341238 5/1984 Fed. Rep. of Germany .

*Primary Examiner*—Andrew M. Falik
*Attorney, Agent, or Firm*—Peter K. Kontler

[57] ABSTRACT

The warp beam and/or cloth beam of a loom is driven by a programmable stepping motor. The speed of the motor is regulated, preferably in such a way that the tension of the warp threads remains constant. Improved tension control is obtained by further programming the motor to take into account the type of weave in the fabric being produced. This is accomplished by inputting information pertaining to the distance covered by the warp threads between their intersections with neighboring weft threads.

4 Claims, 2 Drawing Sheets

METHOD OF REGULATING THE SPEED OF WARP THREADS AS A FUNCTION OF WEAVE PATTERN AND WARP TENSION

CROSS-REFERENCE TO RELATED APPLICATION

This is a continuation-in-part of copending patent application Ser. No. 07/243,302 filed as PCT/DE88/00005 for "Method of regulating the tension of the warp threads in weaving machines", now abandoned.

BACKGROUND OF THE INVENTION

The invention relates to a method of and to an apparatus for regulating the tension of warp threads.

West German Utility Model No. 82 22 751 discloses an apparatus for regulating the tension of warp threads. The cloth beam and/or the warp beam of this apparatus is driven by a hydraulic stepping motor which receives stepping instructions by way of a computer-controlled regulating mechanism. Here, the tension of the warp threads is considered in addition to the change in diameter of the bands of goods coiled on the cloth beam and warp beam, respectively. This known procedure renders it possible to regulate the tension of warp threads so as to ensure a constant pull. The type of weave of the fabric is not taken into account.

Published West German patent applications Nos. 33 41 238 and 34 35 391 contain proposals to regulate the tension of warp threads by means of program-controlled stepping motors. Here, the density of the weft threads is considered in the stepping instructions.

OBJECTS OF THE INVENTION

An object of the invention is to take into account the change in the path length of the warp threads between their intersections with weft threads.

Another object of the invention is to provide an apparatus for the practice of the above outlined method.

SUMMARY OF THE INVENTION

To achieve the above objects, it is proposed to include the change in the path length of the warp threads between the individual intersections of the warp and weft threads in the program which takes into account the tension of the warp threads and provides instructions for the motor or motors (for example, stepping instructions for one or more stepping motors).

By virtue of this proposal, significant advantages are obtained for fabrics which are not in the form of single-layered fabrics and are designed with a basket weave. These advantages include improved conditions for the superimposition of the weft threads of the individual fabric layers so that a qualitatively better fabric is achieved.

Length measurements can be provided for feedback control both in front and in back, that is, in the region of the cloth beam and the warp beam.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain presently preferred specific embodiments with reference to the accompanying drawing.

DESCRIPTION OF PREFERRED EMBODIMENTS

The symbols which are used in the following description and in FIGS. 1 to 3 have the following meanings:

I = fabric layer I
II = fabric layer II
K = warp threads
S = weft threads
$T_S$ = weft thread spacing
$L_K$ = warp thread feed lengths
E = crimp factor (%)
D = thread diameter.

Figure 1:
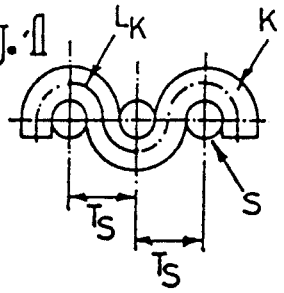
FIG. 1 is a side elevational view of a single-layered fabric in plain weave, the so-called basket weave.

As shown in FIG. 1, the spacing $T_S$, and thus also the warp thread feed length $L_K$, is uniform over the entire length of the fabric so that constant feeds $L_K$, $L_K$, $L_K$ . . . are obtained.

Figure 2:
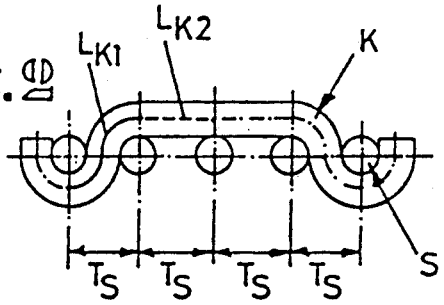
FIG. 2 is a side elevational view of a so-called twill fabric.

In the twill fabric which is shown in FIG. 2, the spacing is also $T_S = 2D$ but different warp thread lengths $L_{K1}$ and $L_{K2}$ exist.

As shown in FIG. 2, the feeds of length $L_{K1}$ and $L_{K2}$ occur in the sequence $L_{K1}$, $L_{K2}$, $L_{K2}$, $L_{K1}$ . . .

Figure 3:
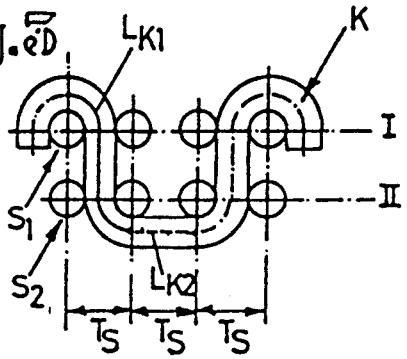
FIG. 3 is a side elevational view of a double-layered fabric.

In the double-layered fabric which is illustrated in FIG. 3, the spacing is once more $T_S = 2D$ but, due to the two superimposed weft threads $S_1$ and $S_2$, a feed sequence $L_{K1}$, $L_{K2}$, $L_{K1}$, $L_{K2}$ . . . is obtained.

The thus obtained theoretical feeds can be programmed into the programming mechanism of a motor, such as a stepping motor, and the motor then, taking into account the different type of fabric and weave, produces a corresponding feed. As a result, a qualitatively better fabric is achievable. The so-called stacking is eliminated.

As already indicated, the spacing $T_S$ in each of FIGS. 1 to 3 is 2D.

The feed length $L_K$ in FIG. 1 is $2D\pi/2 = D.\pi = 3.14D$ while the crimp factor $E = 3.14D/2D = 1.5707$.

The feed length $L_{K1}$ in FIG. 2 is again 3.14D whereas the feed length $L_{K2} = 2D = T_S$. The crimp factor $E = (2.314D + 2.2D)/4.2D = 1.285$.

The feed length $L_{K1}$ in FIG. 3 is $3.14D + D = 4.14D$ while the feed length $L_{K2} = 3D = T_S$. The crimp factor $E = (4.14D + 2D)/2.2D = 1.535$.

Figure 4:
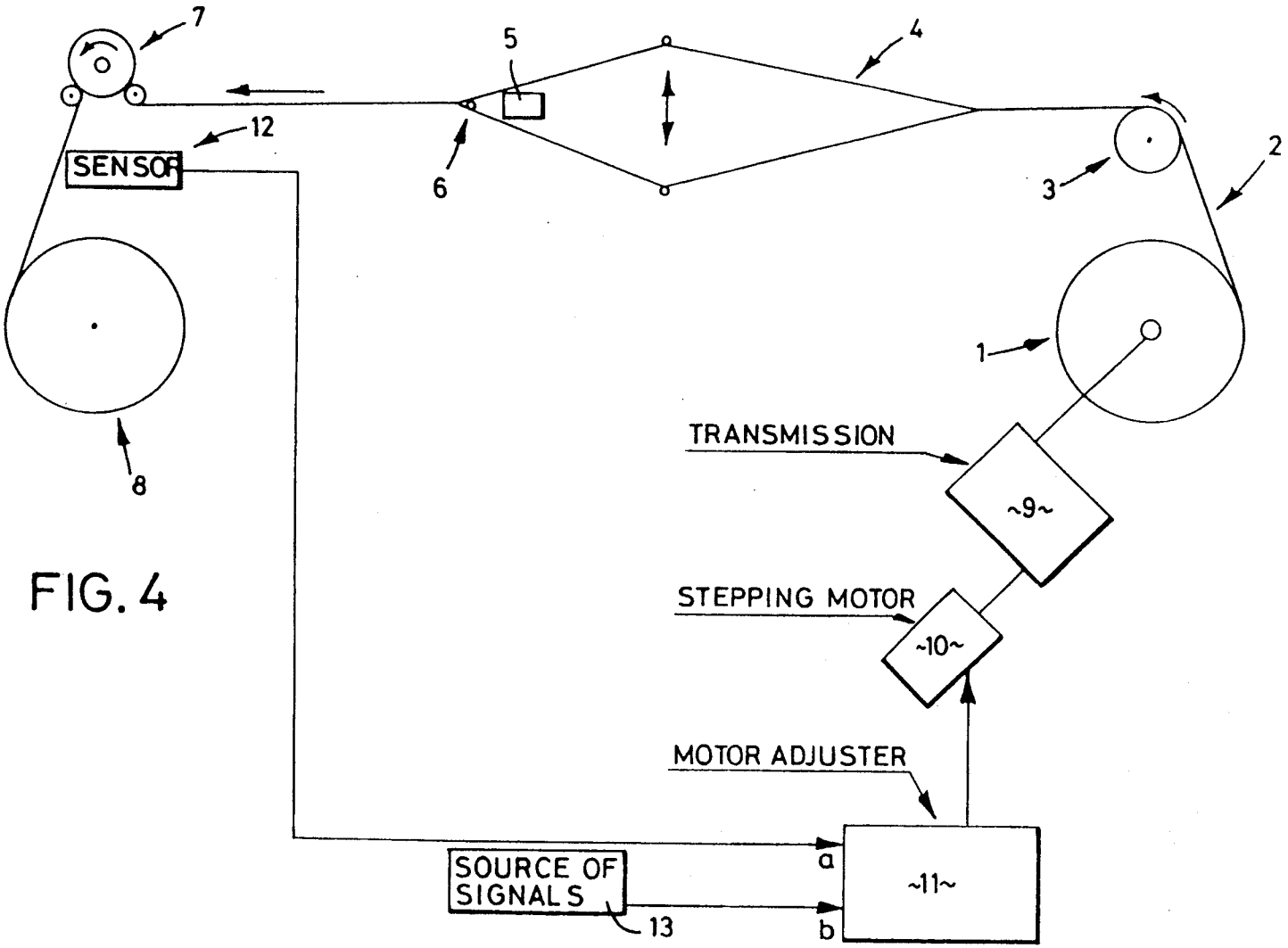
FIG. 4 is a diagrammatic view of an apparatus which can be utilized to practice the improved method.

FIG. 4 shows an apparatus which comprises a warp beam 1 for a set of warp threads 2 which advance from the beam 1 toward the shed 4 by way of a back rest 3. The fabric is formed at 4 in the customary way; FIG. 4 merely shows a shuttle 5 for weft threads and a beat-up 6. The fabric advances over a breast beam 7 and is collected by a cloth beam 8.

One of the beams (the beam 1 in FIG. 4) is driven by a variable-speed prime mover 10 (e.g., a stepping motor) by way of a transmission 9. The speed of the prime mover 10 (and hence the tensioning of warp threads 2) is regulated by an adjusting unit 11 having a first input a for signals from a sensor 12 which monitors the tension of the fabric (i.e., the tension of the warp threads 2) between the breast beam 7 and the cloth beam 8. A second input b of the adjusting unit 11 receives signals from a source 13 serving to furnish information pertaining to the selected type of weave, e.g., the weave shown in FIG. 1, 2 or 3. Thus, the regulating step is performed for both the fabric and the warp threads 2.

It will be appreciated that the adjusting unit 11 (e.g., a commercially available computer) can be provided with additional inputs for reception of other data to be taken into consideration in connection with the making of fabric which is collected by the cloth beam 8. Reference may be had, for example, to U.S. Pat. No. 4,593,236 to Oesterle et al. which discloses a power regulating circuit with a first input for signals from a tachometer generator and a second input for signals from an external signal source to perform idle functions on the weaving machine, such as controlled relaxation of warp threads in the idle state or a prestressing of warp threads when the machine is restarted. The second input can also receive signals from a converter circuit, from a second external circuit or from a signal storage register.

Reference may also be had to the disclosure in U.S. Pat. No. 4,582,095 to Kronholm which describes a computerized pattern recongnition system serving to monitor the warp, the fabric, the edge of the fabric and the density of the weft. The digital information which is furnished by the pattern recognition system can be used in an open or closed control system for selecting the position of the edge of the fabric after an interruption and prior to a restart of the fabric feed. The patentee further proposes to use the pattern recognition system as a means for stopping the fabric feed.

U.S. Pat. No. 4,662,407 to Duncan discloses monitoring the tension of threads upstream and downstream of the shuttle and adjusting the loom when the monitored tension departs from the desired tension.

An advantage of the improved method and apparatus is that the external signal source 13 furnishes information pertaining to the selected type of weave (e.g., basket weave, twill fabric weave or another weave). This feature renders it possible to introduce another (heretofore disregarded) parameter which can exert a beneficial effect upon the quality of the fabric. While it is already known to continuously monitor the tension or density of an advancing fabric and/or of the threads which are to form the fabric, the apparatus of the present invention provides adjusting means 11 (such as a central processor) and a signal source 13 which furnishes to the adjusting means a signal at the start of a new weaving cycle (i e., when the apparatus is to switch from a first pattern to a different second pattern) in order to change the tension in accordance with the newly selected pattern and/or binding of the fabric.

The regulating step can include maintaining the tension of the warp threads 2 substantially constant in the course of the weaving step at 4. The sensor 12 continuously monitors the tension of the warp threads 2 to ensure that the controlling step can include adjusting the speed of the warp threads in response to changes of tension of such threads.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A weaving method comprising the steps of advancing a first set of threads at a variable speed along a first path; conveying a second set of threads along a second path transverse to said first path, said first and second paths having an intersection; weaving the threads of said first set with the threads of said second set at said intersection to form a fabric having a predetermined weave in which each thread of said first set advancing between different threads of said second set defines across the fabric a predetermined pattern which is a function of the distance covered by the respective thread of the first set; advancing the fabric along a predetermined path; monitoring the tension of the first set of threads; and regulating the tension of the fabric and of the threads of the first set, including controlling the speed of the first set of threads in dependency on said predetermined pattern and in dependency on the monitored tension.

2. The method of claim 1, wherein the threads of the first set are warp threads and the threads of the second set are weft threads, said advancing step including advancing the warp threads step-by-step.

3. The method of claim 1, wherein said regulating step includes maintaining the tension of the first set of threads substantially constant in the course of said weaving step.

4. The method of claim 1, wherein, said controlling step includes adjusting said speed in response to changes of tension of the first set of threads.

* * * * *